US006338229B1

(12) United States Patent
Botzen

(10) Patent No.: US 6,338,229 B1
(45) Date of Patent: Jan. 15, 2002

(54) WALL STRIP WITH RAISED BEAD FOR PLASTER SCREEDING COMPRISING TWO NAILING STRIPS CONNECTED BY A RISER STRIP CONFIGURATION

(76) Inventor: James T. Botzen, 3548 Shaddick, Waterford, MI (US) 48328

( * ) Notice: Subject to any disclaimer, the term of this patent is extended or adjusted under 35 U.S.C. 154(b) by 0 days.

(21) Appl. No.: 09/602,534

(22) Filed: Jun. 23, 2000

(51) Int. Cl.[7] ..... E04B 2/00

(52) U.S. Cl. ..... 52/371; 52/287.1; 52/288.1; 52/716.8

(58) Field of Search ..... 52/371, 364, 367, 52/459, 461, 463, 287.1, 288.1, 443, 448, 631, 712, 715, 716.8

(56) References Cited

U.S. PATENT DOCUMENTS

| | | | | |
|---|---|---|---|---|
| 2,969,616 A | * | 1/1961 | Gustafson | 52/288 |
| 4,128,982 A | | 12/1978 | Weaver | 52/367 |
| 4,238,915 A | | 12/1980 | Yoshida et al. | 52/510 |
| 4,553,363 A | * | 11/1985 | Weinar | 52/288 |
| 4,624,087 A | | 11/1986 | Schneller | 52/254 |
| 5,079,880 A | | 1/1992 | Reid | 52/35 |
| 5,154,536 A | | 10/1992 | Ciudaj | 404/118 |
| 5,517,794 A | | 5/1996 | Wagner | 52/276 |
| 5,531,051 A | | 7/1996 | Chenier, Jr. et al. | 52/255 |
| 5,699,638 A | | 12/1997 | Maylon | 52/86 |
| 5,722,746 A | | 3/1998 | Hull et al. | 312/140.3 |
| 5,768,849 A | | 6/1998 | Blazevic | 52/737.3 |
| 5,970,671 A | | 10/1999 | Bifano et al. | 52/254 |

* cited by examiner

*Primary Examiner*—Carl D. Friedman
*Assistant Examiner*—Naoko Slack
(74) *Attorney, Agent, or Firm*—Gifford, Krass, Groh, Sprinkle, Anderson & Citkowski, PC

(57) ABSTRACT

Articles are disclosed for preparing a uniform thickness bed of mortar or 'mud' on a wall to receive a facing material. The article includes a first edge oriented lengthwise along the stock for contact against the surface of a first wall to be faced, and a second edge parallel and spaced apart from the first edge by a predetermined distance, the second edge providing a screed against which a tool may be drawn to smooth a cement layer on the first wall having a thickness substantially equal to the predetermined distance. Different embodiments of the invention are applicable to different construction situations, including flat walls, outside corners, inside corners, above doorways and other openings. In one embodiment, a corner bead is used to create a finished edge with tile or stone on one side of a corner, with a drywall mud finish on the other side of the corner. During installation of tile or stone, an edge of the article is used as a screed, and ultimately becomes the finished edge of the tile or stone installed. A straight wall bead embodiment is used to create a finished edge with tile or stone on one portion of a flat wall, and drywall mud finish on the other side of the flat wall.

17 Claims, 11 Drawing Sheets

DIMENSIONS IN INCHES
NOT TO SCALE

WALL STRIP WITH RAISED BEAD FOR PLASTER SCREEDING COMPRISING TWO NAILING STRIPS CONNECTED BY A RISER STRIP CONFIGURATION

FIELD OF THE INVENTION

This invention relates generally to the construction industry and, more particularly, to specialized corner beads, and the like, which provide one or more screed surfaces for the application of mortar for facing materials.

BACKGROUND OF THE INVENTION

The traditional method of installing tile or stone onto an existing wall uses at least two "float strips," typically wooden laths, imbedded into a bed of mortar troweled around a metal mesh having diamond-shaped openings. The mortar is "floated" between and around the float strips, and screeded off with a straight-edge against the float strips to form a "setting bed" for the subsequent installation of the facing material. The float strips are pulled out of the mortar, and the rectangular channels left behind are then filled with mortar and troweled flat, after which the float strips are washed off and saved for the next floating. When the setting bed or layer of mortar is complete, the tile or stone is applied with cement to the vertical mortar surface, and the wall is finished.

Various tools and techniques have been proposed over the years to make this process more efficient or more predictable. According to U.S. Pat. No. 4,128,982, the basic process outlined above remains the same, with the exception that a diamond mesh plastic lath is used in place of the metal lath. According to the inventors, because of the humid areas in which tile walls are often put, the metal lath begins to rust very quickly after installation and contributes to the rapid deterioration of the wall supporting structure. In addition, the diamond mesh has very sharp points, and is very difficult to cut with tin snips and install without somehow in the process winding up with multiple cuts and scratches.

The same or a similar process is used in conjunction with the application of mud-set floor tiles. According to U.S. Pat. No 5,154,536, most tile contractors use a wood float strip application which involves setting a 1½ inch by ⅛ wood strip on a previously applied row of mortar. The wood strip is pressed into place and leveled to a height of 1¼ inch above a plywood subfloor while the mortar row is still soft. Thereafter, mortar is poured to a height of 1¼ inches to form a cold joint with the previously-applied mortar row. Some of the problems involved with wood float strip application include the fact that such cold joints almost always crack with ease, and it is difficult to keep the edges of the wood level.

According to the '536 patent, this problem is addressed by providing a screed guide or rail formed of hardened, folded metal. The guide comprises two parts, a top "T" shape, and a bottom inverted "T" shape. The top "T" fits into the lower inverted "T", thereby forming an elongated wide-based I-beam. The screed guide or rail is attached to a subfloor panel where mortar or cement will be laid. The screed guide or rail can then be adjusted as to height by sliding the top piece up or down to create a level surface to screed from. Once the surface is made level, the two parts may be bolted together through elongated slots. Mortar or cement is then poured around the screed guide or rail, which becomes a metal reinforcement of the cement or mortar. The lips provided on the top and bottom flanges formed by the tops of the respective "T" s are significant in that they lock the cement or mortar bed to both sides of the screed guide or rail. Also, the top flange is significantly narrower than the bottom flange to enable the user to easily secure the screed guide or rail to the subflooring or to a wall.

U.S. Pat. No. 5,722,746 discloses a corner tile support strip for use in conjunction with a tile-covered structure. The strip is attached between the vertical surface and the vertical leg sections of the corner tiles, and includes an "L-shaped" first main body screed and an elongated rectangular stress barrier member, with the stress barrier member being attached to the screed by caulking.

U.S. Pat. No. 5,970,671 describes a construction accessory for use with a construction panel. The accessory includes a flange having an inner surface adapted to face the construction panel, and an outer surface opposite the inner surface. The flange further includes at least one perforation extending through the flange between the inner surface and the outer surface and a depression in the inner surface. The depression is in communication with said at least one perforation.

U.S. Pat. No. 5,079,880 is directed to a trim for trimming out or finishing contemporary, one-piece fiberglass and acrylic bathtubs and shower stalls. The trim includes framing pieces which are positioned around the edges of the surrounding wall portion of a bathtub or shower stall after the bathtub has been installed. A large flange portion of each framing piece is secured to the wood stud framing or wall using wood screws. The large flange portion and a small flange portion extend from a base portion and form a cavity for receiving an edge of a dry wall sheet. The trim may include separate finishing pieces which snap-on to an outer surface of the small flange portion of the framing pieces. Alternatively, the small flange portion of the framing pieces may be formed with a finished surface thereby dispensing with the need for separate finishing pieces.

U.S. Pat. No. 4,624,087 resides in a formed sheet metal corner bead for use with drywall. The bead includes a channel portion for mounting on the edge of one sheet of wallboard, and a narrow double layer flange extending laterally outward to cover the edge of a second sheet of wallboard which forms an exterior corner with the first sheet of wallboard.

Thus, although the prior art includes various articles providing screed surfaces and beads for use with drywall corners, the need remains for a corner or wall strip that helps to finish the transition from a tile or stone facing to a wall section that does not feature such a facing.

SUMMARY OF THE INVENTION

This invention is directed to articles for preparing a uniform thickness bed of mortar or 'mud' on a wall to receive a facing material. Broadly, an article according to the invention includes a length of formed stock, such as plastic, aluminum or steel in a multi-foot length, preferably 8 or 10-foot lengths. The article includes a first edge oriented lengthwise along the stock for contact against the surface of a first wall to be faced, and a second edge parallel and spaced apart from the first edge by a predetermined distance, the second edge providing a screed against which a tool may be drawn to smooth a cement layer on the first wall having a thickness substantially equal to the predetermined distance.

Different embodiments of the invention are applicable to different construction situations, including flat walls, outside corners, inside corners, above doorways and other openings. In one embodiment, a corner bead is used to create a finished edge with tile or stone on one side of a corner, with a drywall mud finish on the other side of the corner. The article is installed after installation of drywall board, and prior to installation of cement and drywall mud. During installation of tile or stone, an edge of the article is used as a screed, and ultimately becomes the finished edge of the tile or stone installed. Use of the article eliminates the labor typically required to fill the gap behind the tile or stone caused by the addition of the cement or Durock®. A no-trim version of the corner bead embodiment eliminates the need for bull-nose tile tri or polished stone edges. Through appropriate adjustment, the article may accommodate different tile or stone thickness.

A straight wall bead embodiment is used to create a finished edge with tile or stone on one portion of a flat wall, and drywall mud finish on the other side of the flat wall. Any wall where stone or tile meets drywall on a flat surface is a candidate for this embodiment. A no-trim version eliminates the need for bull-nose tile trim or polished stone edges.

An inside corner embodiment is used on an inside corner where stone or tile meets with stone or tile. Using the inside corner unit as a screed, the excess cement is removed using a straight edge from one inside corner unit to the appropriate screed, leaving a flat edge on cement. The inside corner unit, acting as a screed, can be used with any other form of screed whether inside corner, outside corner, or straight wall. The inside corner embodiment also helps to eliminate corner cracks, as it provides both corner planes in a single unit, and is completely embedded in cement.

An outside corner embodiment is used on an outside corner where stone or tile meets with stone or tile. Appropriate uses would include shower seats, curbs, doorways, niches, and windows. The unit is installed in the same manner as the inside corner embodiment, and similarly, acts as a screed, leaving a flat edge on cement upon completion.

Different tile-holding embodiments, with and without a screed, are used above doors and windows, or any opening to be tiled. Articles according to this embodiment may be installed horizontally above an opening after drywall installation and prior to cement application. The stone or tile is set on the protruding lip of the tile hold u nit, and prevents slipping or sagging of the stone until the adhesive or thin-set dries, or until proper bonding is achieved. When tile trim is placed on the protruding lip of the unit, the protrusion is concealed within the grout joint.

DETAILED DESCRIPTION OF THE INVENTION

The present invention is directed to elongated forms which, when used with various wall coverings such as tile and stone, provides a clean, finished look with relatively little effort. This is accomplished through various embodiments used in different locations in a room, including inside and outside corners, above doors, and so forth, wherein, in each case, one or more screed edges are provided against which tools may conveniently be aligned to rapidly produce a sharp transition. Although the invention is described in conjunction with ceramic tile and stone, it will be appreciated by one of skill in the art that through appropriate dimensional modification, the invention may be used with any type of wall covering, regardless of thickness or composition, including metal or plastic tiles or sheets, brick facing, and so forth.

Figure 1B:
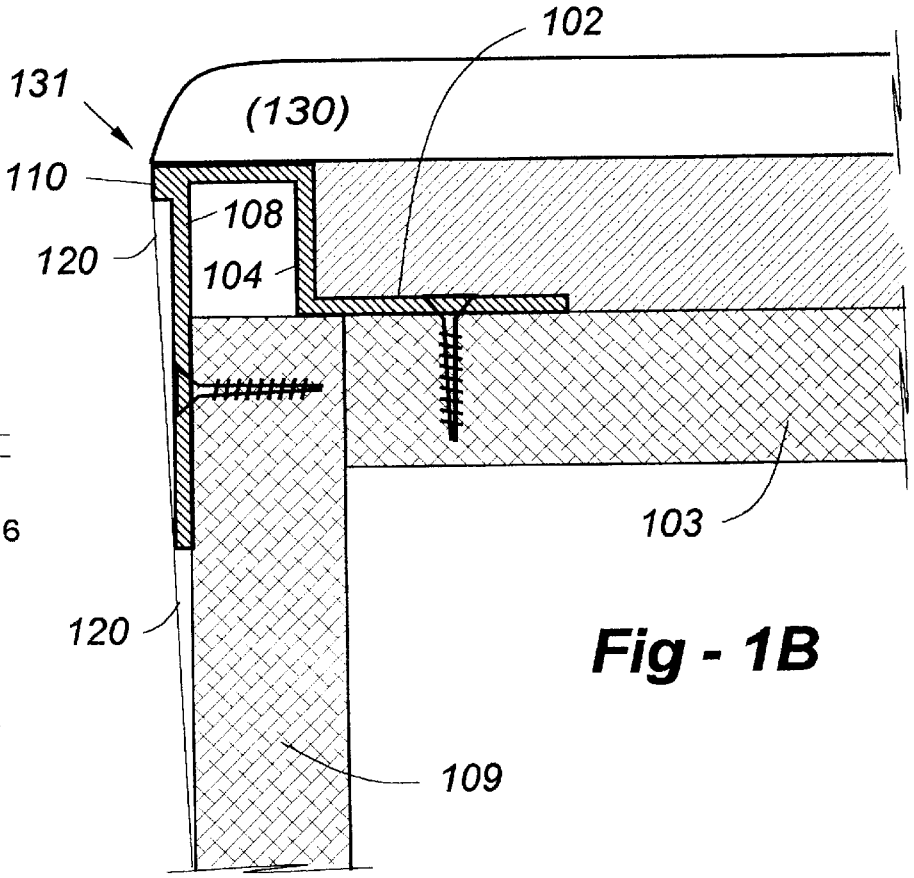
FIG. 1B is a cross-sectional view of the way in which the corner bead of FIG. 1A is correctly installed.
Figure 1A:
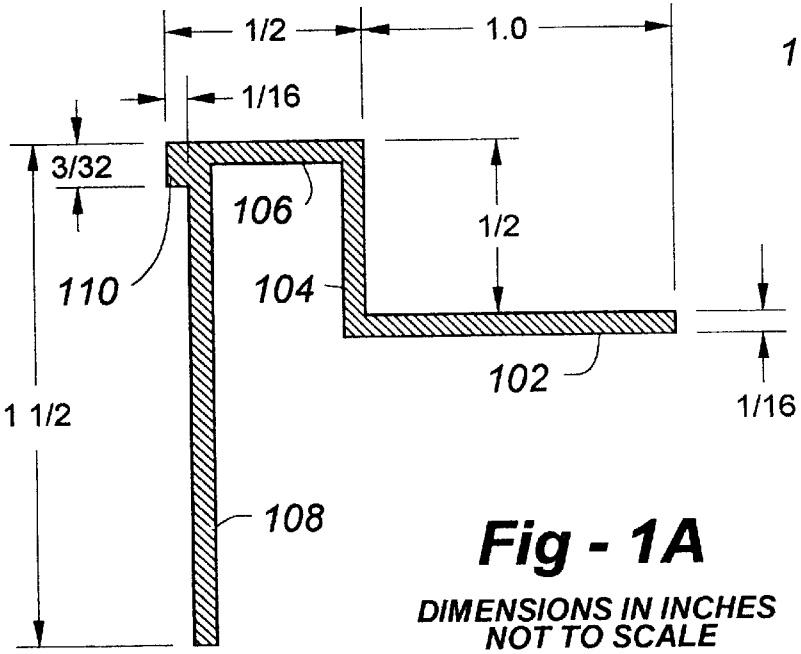
FIG. 1A is a drawing of a corner bead according to the invention, including preferred dimensions.

FIG. 1A is a drawing in cross-section which shows a basic corner bead according to the invention, which is used where a tile, stone or other facing material forms a corner with a wall not having such a facing, as shown in FIG. 1B. In this and the other embodiments disclosed herein, the material comprising the bead is preferably a metal such as aluminum or steel, though alternative materials, including other metals and plastics may be utilized, depending upon the application. The articles may be provided in any length, though eight-foot lengths are preferred for wall applications, with the material being cut with tin snips, for example, to accommodate shorter applications, or additional beads may aligned end-to-end for longer requirements.

FIG. 1A shows the preferred dimensions of the basic corner bead embodiment, with the understanding that most of these dimensions are variable, depending upon the desired thickness of mud, joint compound, and so forth. The structure includes an edge, preferably in the form of strip 102 which is nailed to the wall ultimately receiving the facing material. The width of this strip is preferably one inch, and preferably includes a pattern of perforations along its length to assist with nailing. As with existing drywall corner beads, however, non-perforated strips may be used, since the thickness of the material, $1/16^{th}$ of an inch or thereabouts, may conveniently allow a nail, screw or other fastener to readily perforate the material even if a hole for such purpose of not provided.

Joined to the nailer strip 102 is a riser strip 104, preferably having a width of one-half inch to accommodate existing cement panels such as Durock®, or to provide a sufficient mud bed, as best shown in FIG. 1B. Joined to the riser 104 is a screed edge, preferably in the form of a surface 106, also preferably having a width of one-half inch, though this dimension is clearly variable Joined to the screed edge 106 is a strip 108 which is nailed to a wall not having a thick facing but rather, having a smooth finish provided by drywall or lath-and-plaster. A raised bead 110 is preferably provided with an appropriate height for use with a joint compound trowel, so as to cover the nailing strip 108 with filler 120 as shown in FIG. 1B. Although the bead 110 is shown having a square cross-section, it will be appreciated that a rounded bead may also be used.

FIG. 1B shows the corner bead of FIG. 1A, having been installed. As seen in the figure, nailing strip 102 is attached to wall 103, which is to be resurfaced with tile or stone 130. Nailing strip 108 is attached to wall 109 which is to retain a smooth surface. Although drywall is shown covering both walls, it will be appreciated that in this and the other embodiments described herein, and that other wall surfaces may take advantage of the invention, including poured plaster, lath-and-plaster, stucco, and any other dimensionally stable surface.

Cement or Durock is installed having a thickness equal to the riser strip 104, such that when cement is used, whether in its entirety or a skim coat over a cement sheet, a tool may be placed against screed surface associated with strip 106 and a corresponding screed surface associated with another corner or farther down the wall (not shown), thereby creating a uniform-thickness bed onto which the tile, stone, or other facing material is set or adhered.

Note that when the facing material 130 is properly installed, it may be brought right up to the corner 131, and adhered into place. At the same time, the bead 110 at the corner 131 provides a slightly raised surface for a trowel to ride, thereby resulting in a uniform, finished flat surface appearance when filled with joint component or drywall mud 120, as shown.

Figure 1D:
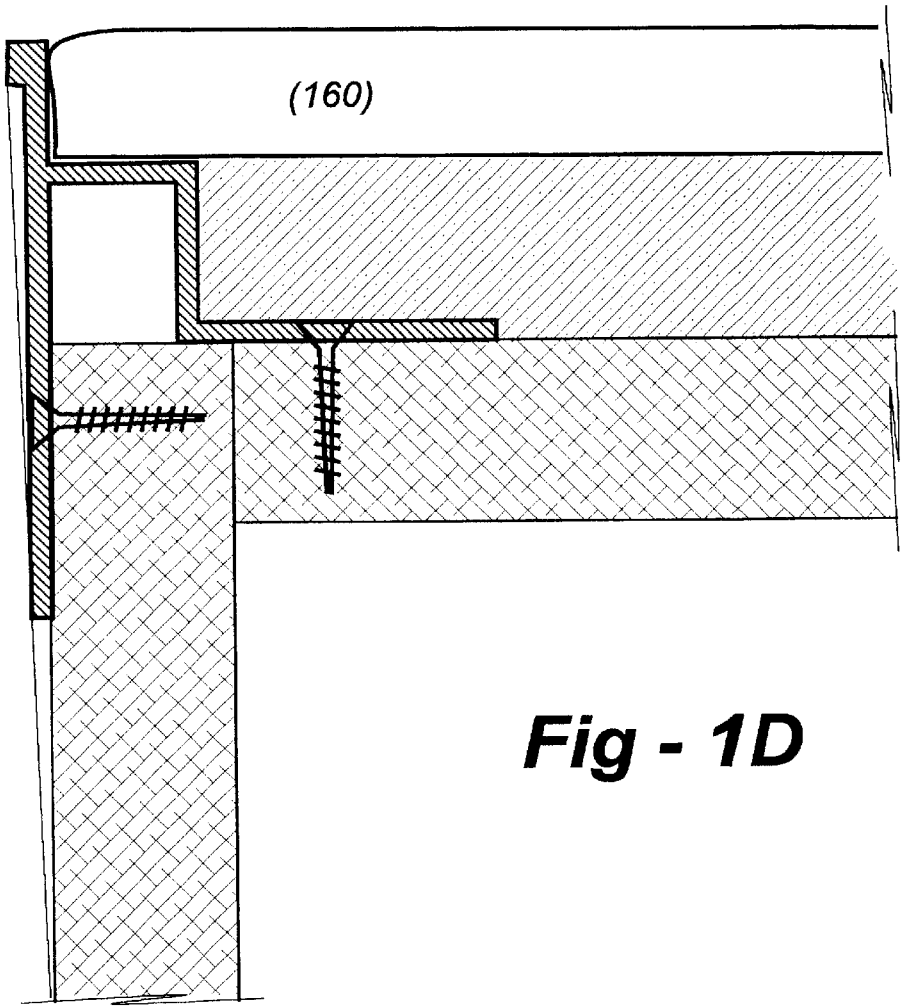
FIG. 1D is a cross-sectional view of the corner bead of FIG. 1C having been installed.
Figure 1C:
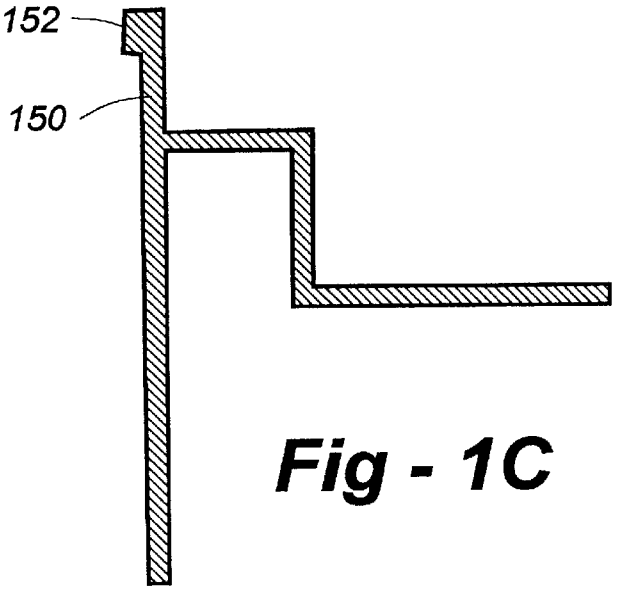
FIG. 1C is a modified version of a corner bead wherein trim is not used.

FIGS. 1C and 1D illustrate a variant embodiment of the invention of FIGS. 1A and 1B, which accommodates tile, stone or other facing materials which do not have a finished or "bull-nose" edge, as depicted in FIG. 1B, in particular. The no-trim corner bead of FIGS. 1C and 1D accordingly includes a wider side strip 150, but again having a drywall tool bead 152, such that when covered with joint compound or drywall mud, the edge of the facing material is covered as well, as opposed to being exposed using the embodiment of FIGS. 1A and 1B.

FIG. 1D shows the embodiment of FIG. 1C having been installed. Note that, with the addition of the wider strip 150, the side of the facing material 160 is disguised to prevent an otherwise unsightly appearance. Such a consideration might be particularly important, for example, in situations wherein custom tile or rough stone is used which does not have a bull-nose component. The extra width 150 is of course variable according to the invention to accommodate different thicknesses of the tile or stone, such as ¼ inch, ⅜ inch, ½ inch or larger.

Figure 2A:
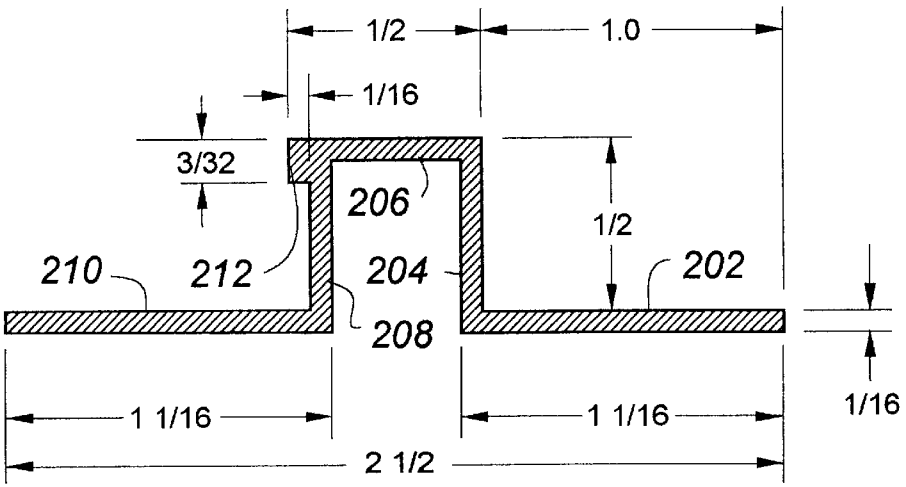
FIG. 2A is a straight wall bead according to the invention, including preferred dimensions.
Figure 2B:
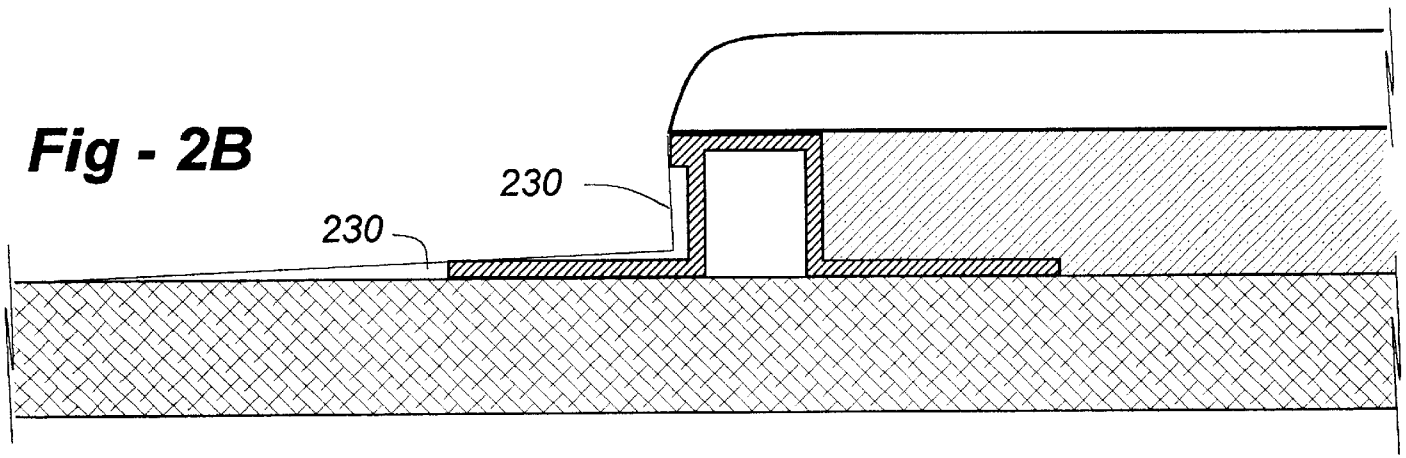
FIG. 2B is a cross-sectional view of the straight wall bead of FIG. 2A following installation.

FIGS. 2A and 2B illustrate an alternative embodiment of the invention for use on a flat wall section as opposed to a corner. FIG. 2A provides desired dimensions for such a configuration. It will be noted that most of the dimensions are preferably the same as those in FIG. 1A, with the exception that instead of a straight nailing strip 108, the strip is bent to form two sections 208 and 210, with 210 being parallel with a strip 202, and both used for nailing purposes onto a flat wall.

FIG. 2B illustrates the embodiment of FIG. 2A, having been installed onto a flat wall. As with the embodiment of FIGS. 1A–1D, riser section 204, preferably having a width of ½ inch, is joined to a section 206 providing a screed surface to create a ½ inch well containing cement board and/or cement. The side strip 208 includes a bead 212, enabling a putty knife, corner trowel or other bladed tool to be used in applying joint compound 230 to cover the surfaces of strips 208 and 210, again leaving a professional, finished appearance.

Figure 2C:
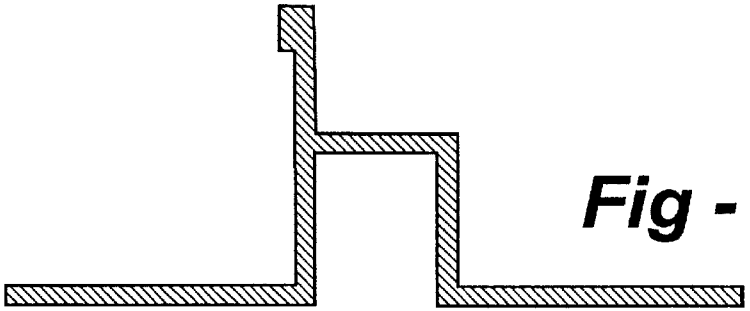
FIG. 2C is a no-trim version of a straight wall corner bead according to the invention.
Figure 2D:
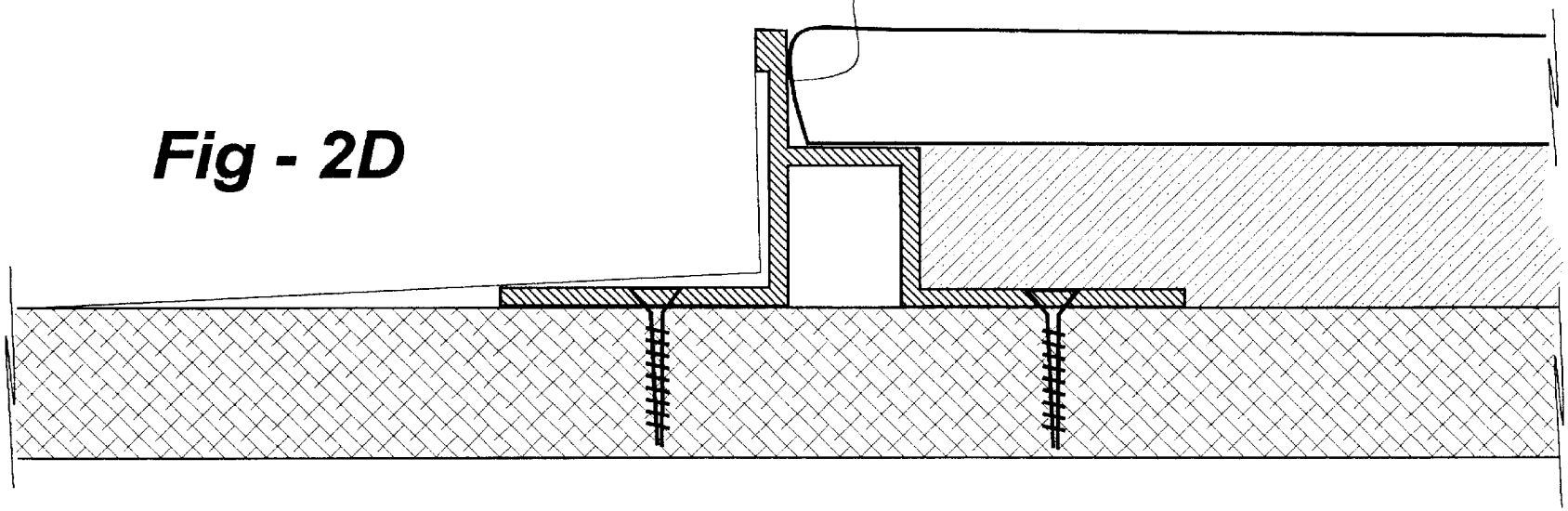
FIG. 2D shows the no-trim straight wall corner bead of FIG. 2C, having been installed.

FIGS. 2C and 2D illustrate a no-trim version of the invention of FIGS. 2A and 2B, wherein the surface of strip 208 is lengthened in a manner analogous to the embodiments of FIGS. 2C and 2D to hide unfinished edges of the facing material, if such is the case. FIG. 2D illustrates the embodiment of FIG. 2C once installed, and better shows how the edges of the facing material 290 are disguised.

Figure 3B:
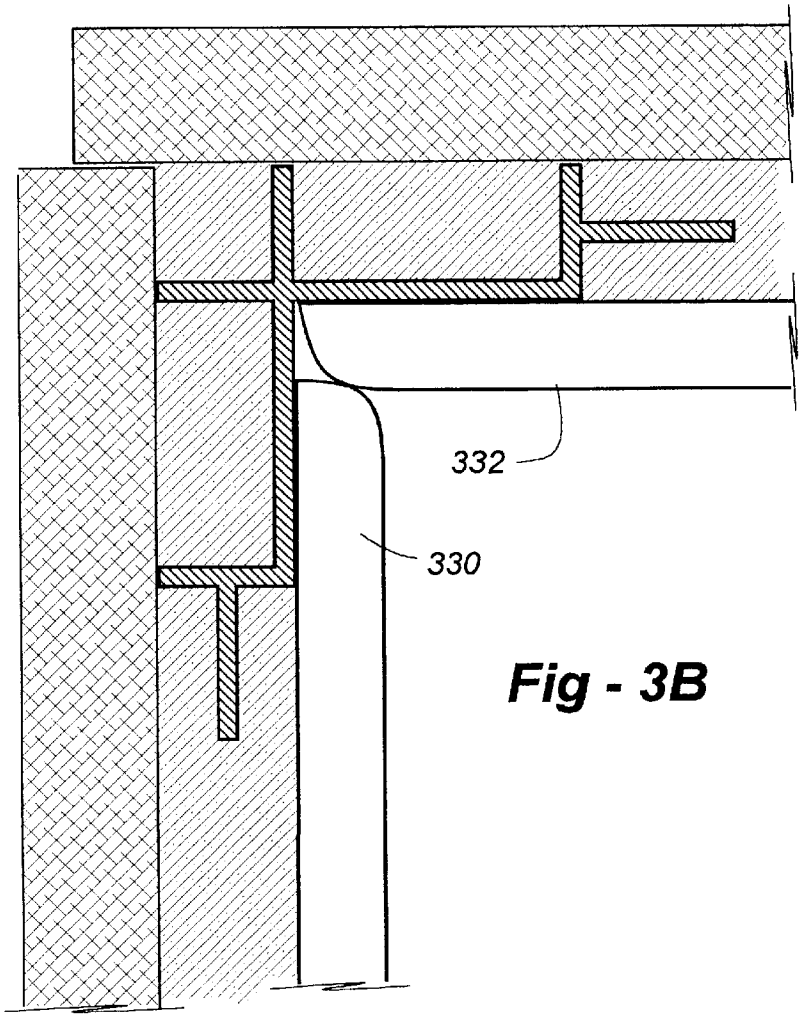
FIG. 3B is a drawing which illustrates the inside corner embodiment of the invention having been installed.
Figure 3A:
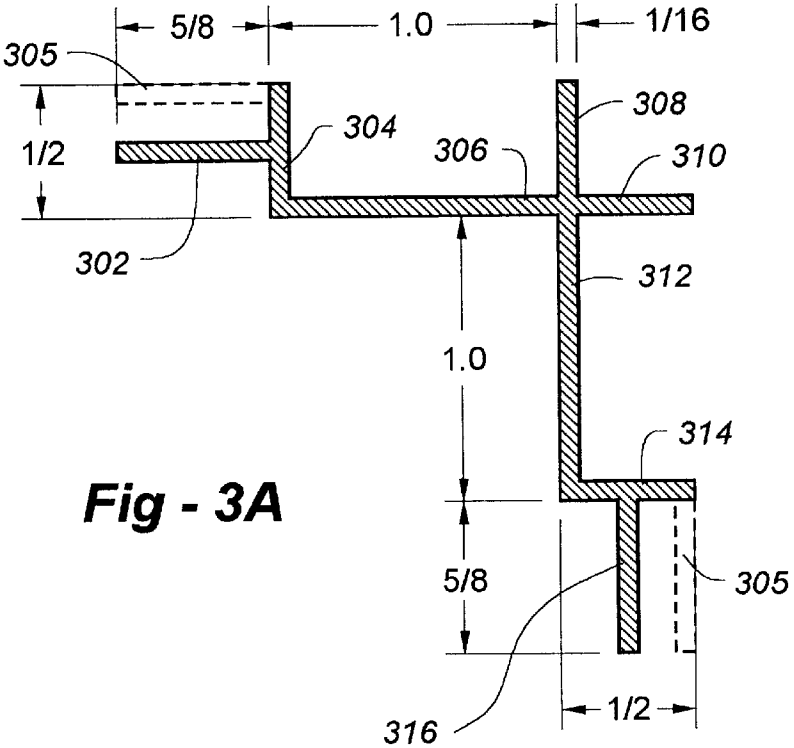
FIG. 3A is an inside corner embodiment of the invention, including preferred dimensions.

FIGS. 3A and 3B illustrate an embodiment of the invention applicable to an inside corner formed by two walls, both of which are to receive facing material. Broadly, according to this embodiment, a riser strip 304 is joined to a strip 306 providing a screed surface with respect to one of the corner walls, which is joined to a strip 312 providing a screed surface with respect to the other wall. The strip 312 is joined to a corresponding riser 314, with both of the risers 304 and 314 preferably having a width of ½ inch for reasons discussed with reference to previous embodiments.

Preferably, with respect to the embodiment of FIGS. 3A and 3B, fins 302 and 316 are provided, so that when cement is troweled onto the two walls, the fins become embedded in the cement to prevent cracking and to stabilize the overall configuration. The fins are preferably perforated, allowing the mud to squeeze through. As an alternative to the fins 302 and 316, nailers 305 may alternatively be provided. Although technically unnecessary if the material of the bead is sufficiently rigid, strips 308 and 310 are optionally provided, so that when the bead is placed into the corner, the screed surfaces in particular to do buckle under pressure. Note that the embodiment of FIG. 3A in particular may be used in various other applications, including stairs and steps, including swimming pool steps.

FIG. 3B illustrates the embodiment of FIG. 3A having been installed into an inside corner. Note that the cavities around these strips are filled with mud. This is due to the fact that, according to a preferred installation technique, the corner is first troweled with cement, after which the inside corner bead is pressed into place. This process is best visualized in FIG. 7B. Thereafter, even before the initial corner cement has cured, additional mud is applied, using the surfaces of strips 306 and 312 as screed surfaces to provide a smooth and uniform bed for facing materials 330 and 332.

Figure 4B:
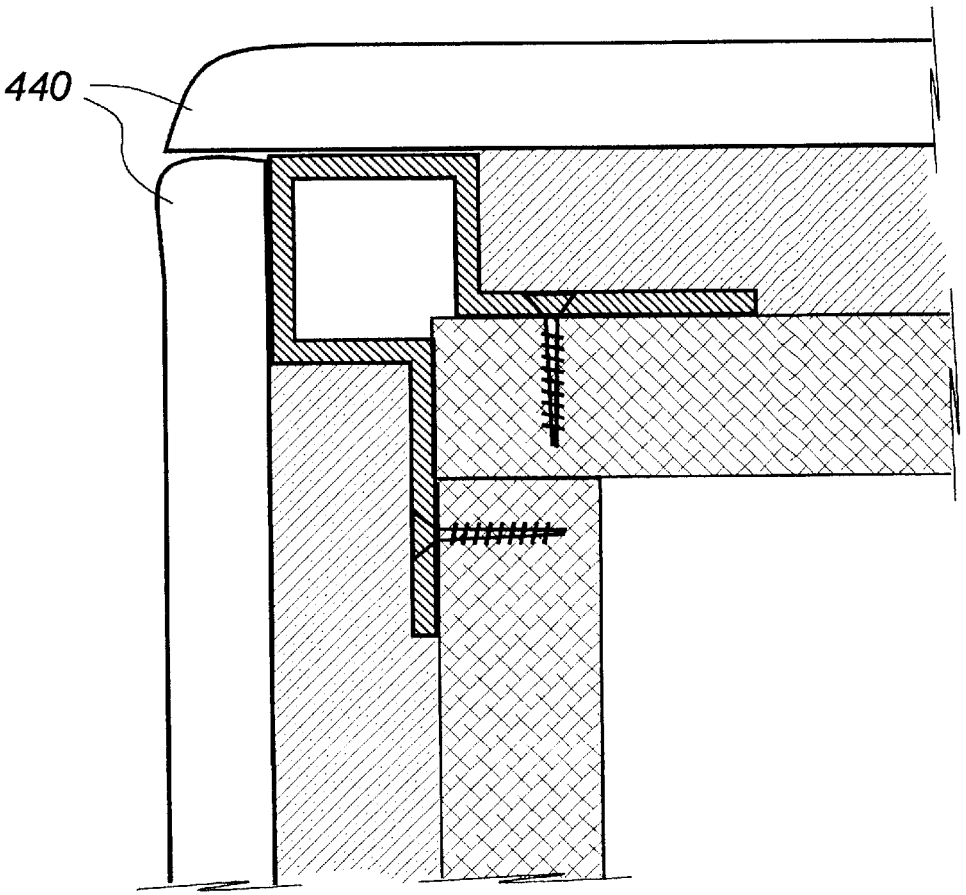
FIG. 4B is a cross-sectional view showing how the outside corner embodiment of FIG. 4A is correctly installed.
Figure 4A:
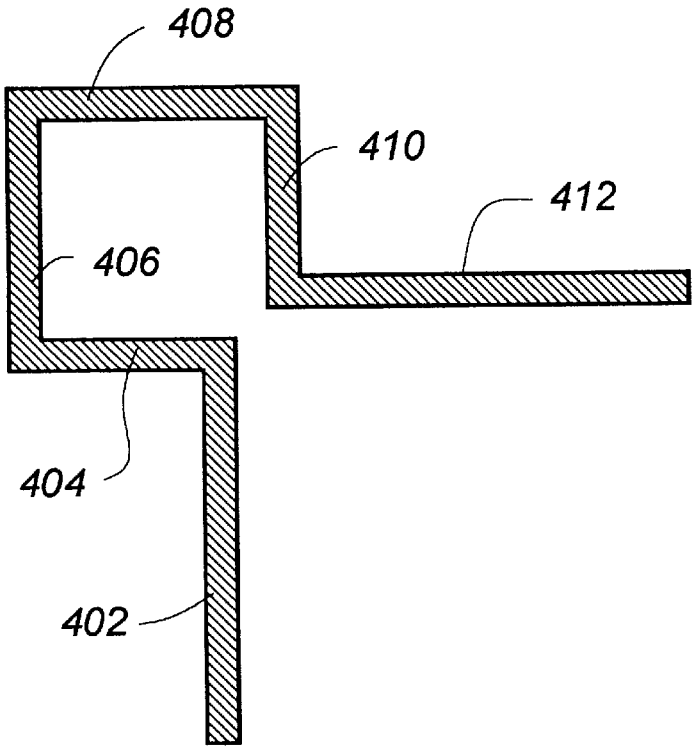
FIG. 4A is an outside corner embodiment of the invention.

FIGS. 4A and 4B illustrate an embodiment of the invention configured for use with outside corners. Preferably, a bead according to this embodiment includes a first nailer strip 402, which is joined to a riser 404 which, in turn, is joined to a first screed edge or surface 406 associated with one of the walls forming the corner. The first screed surface 406 is joined to a strip 408 providing a second screed edge or surface associated with the other wall forming the corner. Strip 408 is joined to a second riser 410, which is joined to a second nailer 412 associated with the second wall. Analogous to other embodiments disclosed herein, the width of the riser strips are preferably ½ inch.

FIG. 4B illustrates the outside corner unit of FIG. 4A installed on wall surfaces forming the corner. It should now be evident that, having fastened the strips 402 and 412 to the adjoining walls, the surfaces of strips 402 and 412 are used to screed cement in place, followed by the application of tile, stone or other facing material 440, as shown.

Figure 5B:
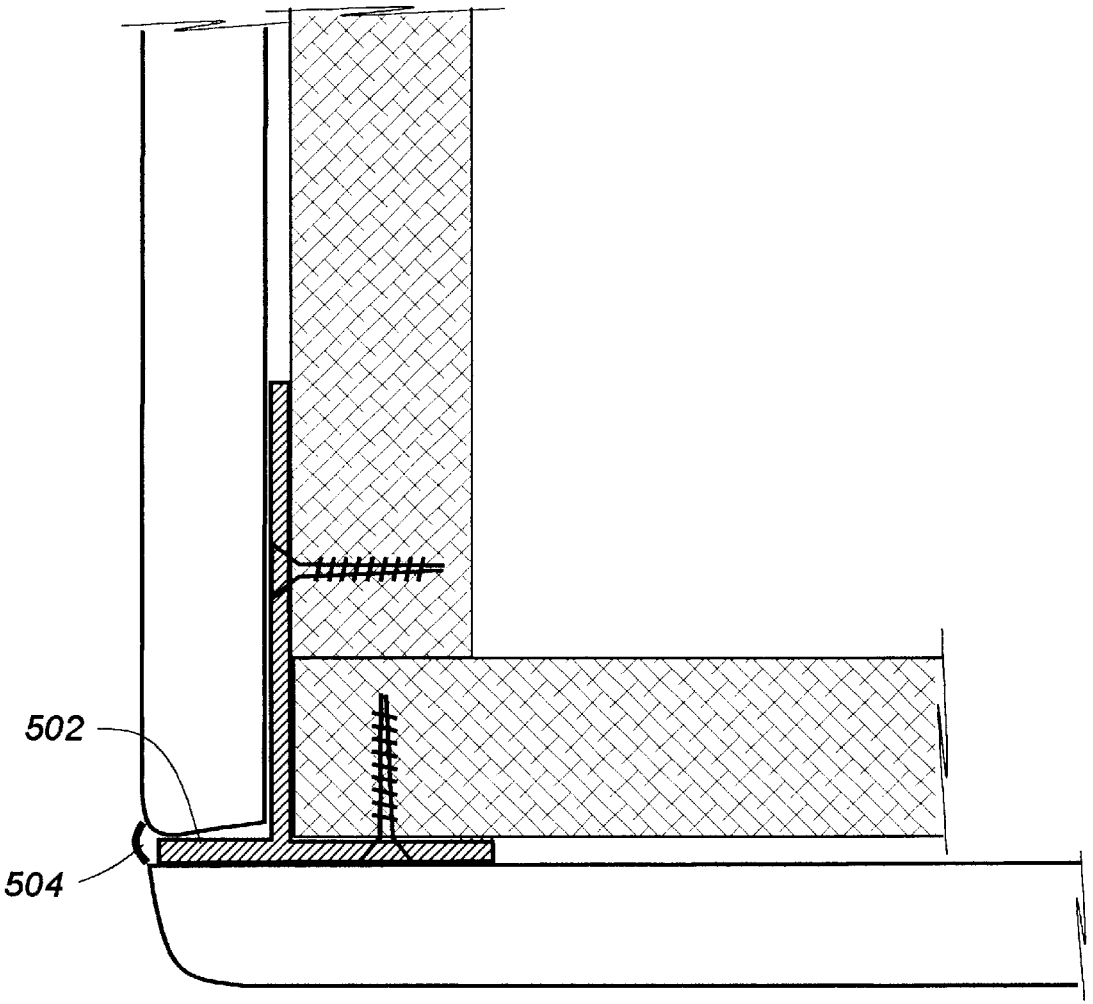
FIG. 5B is a drawing showing how the embodiment of FIG. 5A is correctly installed.
Figure 5A:
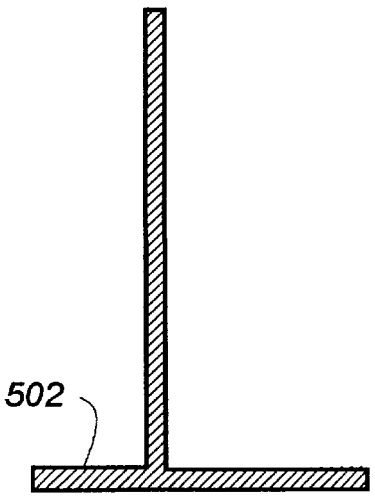
FIG. 5A is one embodiment of the invention used to hold tile above a door.
Figure 6B:
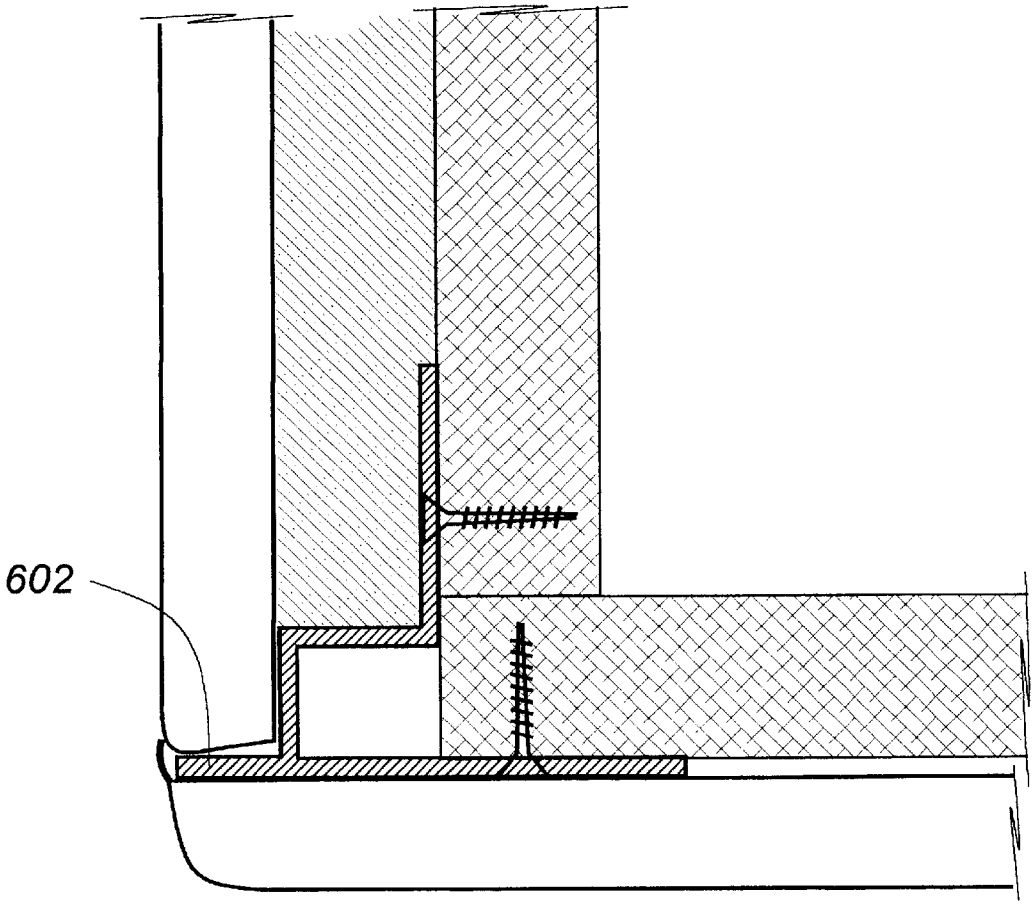
FIG. 6B is a drawing which shows how the embodiment of FIG. 6A is correctly installed.
Figure 6A:
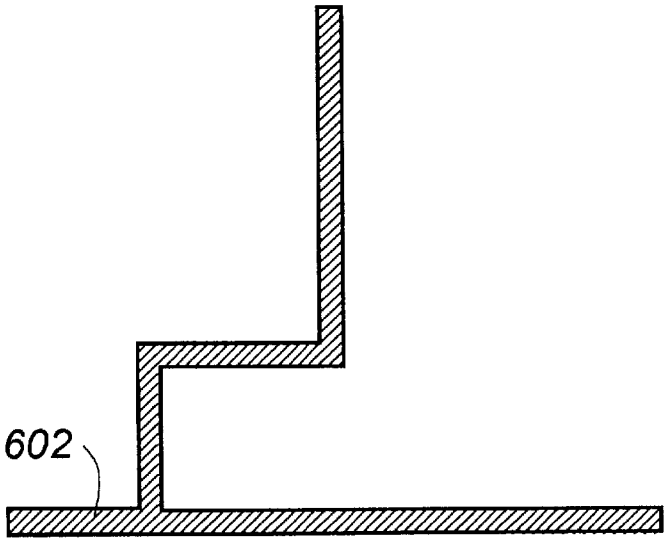
FIG. 6A is a second embodiment of the invention used to hole tile above a door.

FIGS. 5A and 5B illustrate such a hold unit without a screed, whereas FIGS. 6A and 6B illustrate a hold unit with screed. Both are used above doors and windows or any opening to be tiled. In general, the units are installed horizontally above an opening after drywall installation, but prior to cement application. The stone or tile is set on the protruding lip such as 502 in FIG. 5A or 5B, or 602 in FIGS. 6A and 6B, which prevents slipping or sagging of the stone or tile until the adhesive or thin set dries, or until proper bonding is achieved. The thickness of the elements used is such that when the tile trim is placed on the protruding lip of the unit, the protrusion is concealed within a grout joint.

Figure 7A:
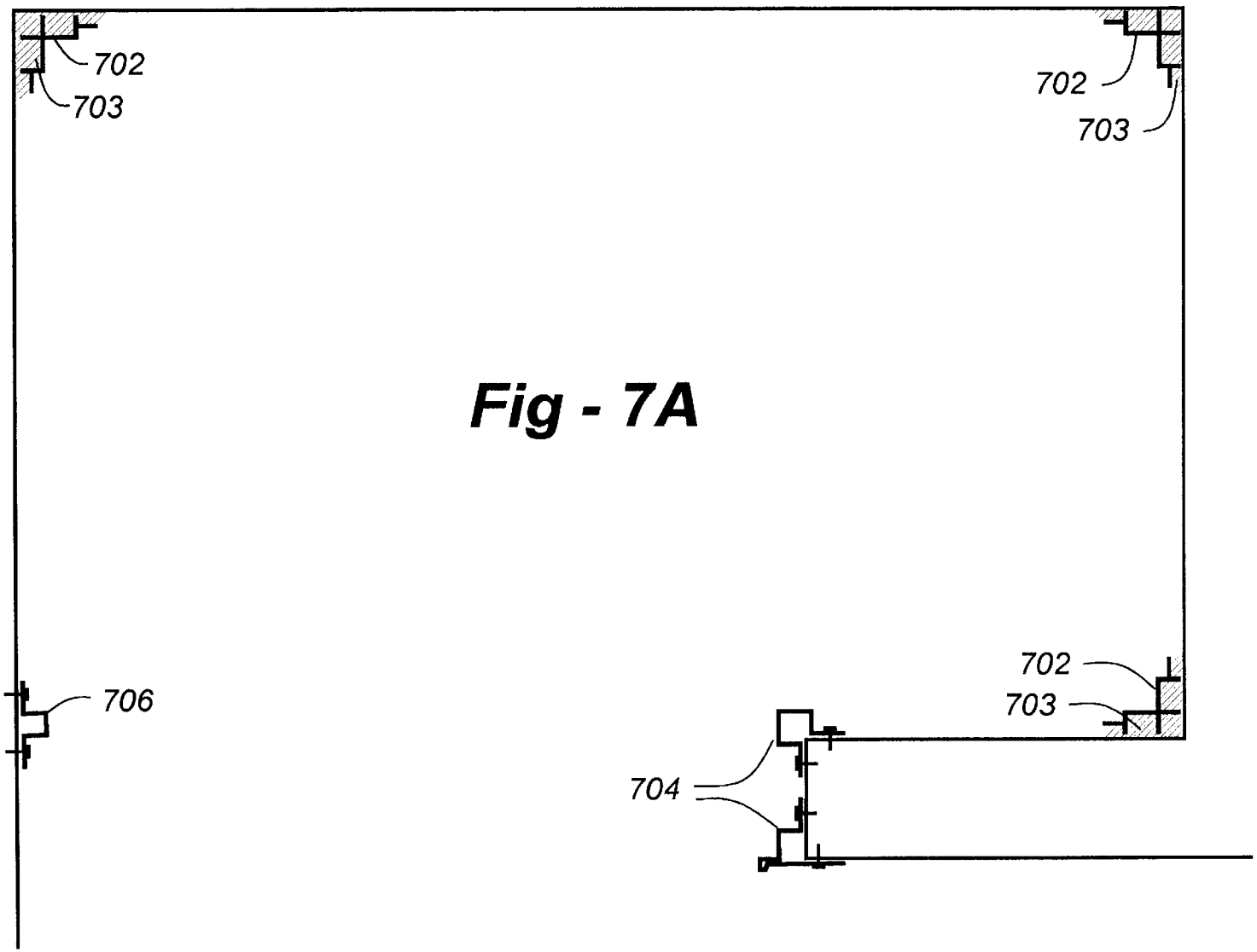
FIG. 7A is a floor plan of a room illustrating the way in which certain embodiments of the invention, including inside and outside corners.
Figure 7B:
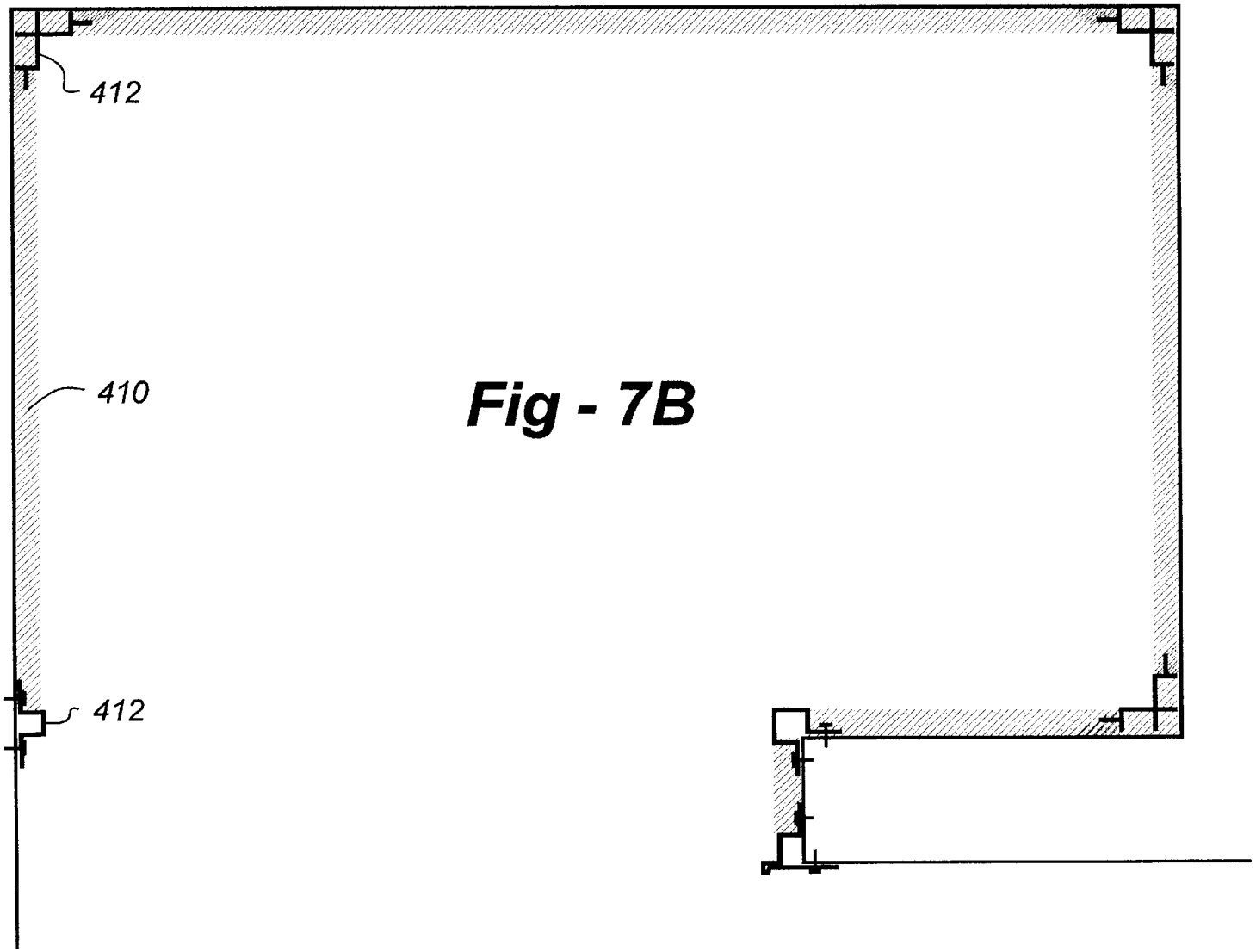
FIG. 7B shows the floor plan of FIG. 7A with inside corners having been set in place.
Figure 7C:
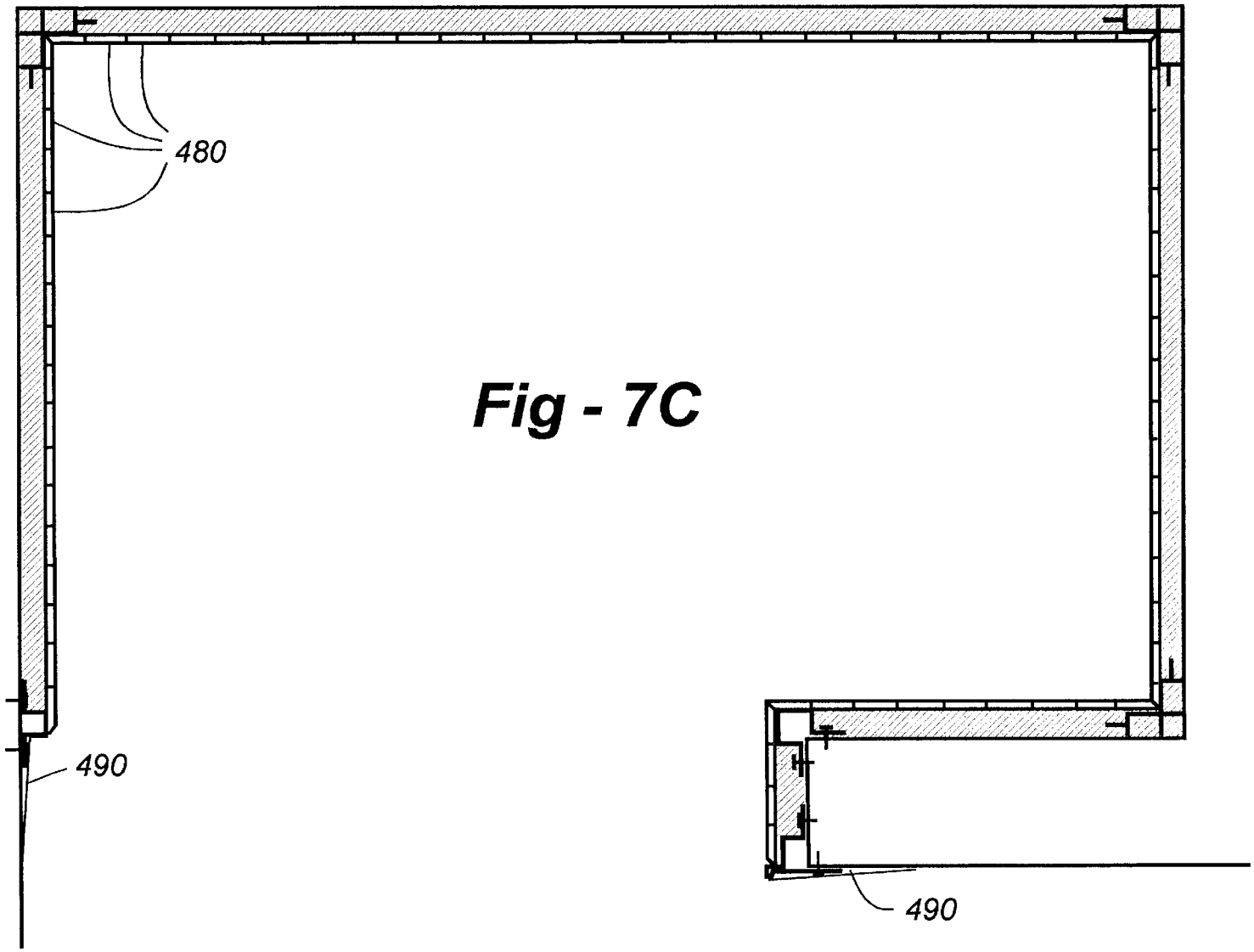
FIG. 7C shows the floor plan of FIG. 7B with wall coverings in place.

FIGS. 7A–7C illustrate the way in which inside corner units 702 are used in conjunction with outside corner unit 704 and wall unit 706 to completely enclose the walls of a room, as might be the case with a shower stall. In FIG. 7A, the inside corner units 702 have been set into the corners using mud 703, whereas outside corner unit 704 and wall unit 706 have been nailed, screwed or otherwise fastened into place. In FIG. 7B, the screed surfaces made available by the invention are used to provide a uniform thickness of mud at all places where tile or stone is to be set. Using the left wall in FIG. 7B as an example, a screed tool is placed against edges or surfaces 412, to produce a uniform thickness bed 410. A similar process is used on the other walls. In FIG. 7C, the project is finished through the application of tiles 480, and joint compound 490, thereby producing a very uniform appearance in very little time.

I claim:

1. An article for preparing a uniform thickness bed on a wall to receive a facing material, comprising:

a length of formed stock, including:

a first strip oriented lengthwise along the stock, the first strip being configured for contact against the wall to be faced;

a riser strip extending from the first strip and transitioning to an edge, parallel to and spaced apart from the first strip by a predetermined distance, the edge providing a screed against which a tool may be drawn to smooth a cement layer on the wall to be faced having a thickness substantially equal to the predetermined distance;

a nailer strip having a surface configured for wall attachment, the nailer strip extending from the edge such that the nailer strip is connected to the first strip only through the riser strip without any direct connection to the first strip.

2. The article of claim 1, wherein the first strip is substantially parallel to the first wall.

3. The article of claim 1, wherein the second edge forms part of a surface which is substantially parallel to the first wall.

4. The article of claim 1, wherein the second edge is spaced apart from the first strip by a distance of ½-inch.

5. The article of claim 1, wherein the nailer strip is substantially perpendicular to the first strip.

6. The article of claim 5, wherein the nailer strip further includes a raised bead against which a trowel may be used to apply joint compound over the nailer strip.

7. The article of claim 1, wherein:

the wall forms an outside corner with a second wall which is not destined to receive facing material; and the nailer strip is substantially flush against the second wall when the article is installed.

8. The article of claim 7, further including a raised bead against which a trowel may be used to apply joint compound over the nailer strip.

9. An article for preparing a uniform thickness bed on a wall to receive a facing material, comprising:

a length of formed stock, including:

a first strip oriented lengthwise along the stock for attaching the article vertically against the surface of a wall to be faced, the first strip having a first edge and a second edge;

a riser strip extending from the second edge of the first strip, the riser strip having a lower edge coincident with the second edge and an upper edge spaced therefrom;

a second strip parallel to and spaced-apart from the first strip by a predetermined distance, the second strip extending from the upper edge of the riser strip in a direction away from the first edge of the first strip, the second strip providing a screed against which a tool may be drawn to smooth a cement layer on the first wall having a thickness substantially equal to the predetermined distance; and a nailer strip having a surface configured for wall attachment, the nailer strip extending from the second strip such that the nailer strip is connected to the first strip only through the second strip and riser strip without any direct connection to the first strip.

10. The article of claim 9, wherein the second strip is spaced apart from the first strip by a distance of ½-inch.

11. The article of claim 1, wherein the second strip is joined to bent strip forming a second nailer strip which is substantially flush against the first wall when the article is installed.

12. The article of claim 9, wherein:

the wall forms an outside corner with a second wall which is not destined to receive facing material; and the nailer strip is substantially flush against the second wall when the article is installed.

13. The article of claim 12, wherein the nailer strip further includes a raised bead against which a trowel may be used to apply joint compound over the nailer strip.

14. An article for preparing a uniform thickness bed on a first wall to receive a facing material where the first wall joins a second wall, the article comprising:

a length of formed stock, including:

a first strip oriented lengthwise along the stock for attaching the article vertically against the surface of the first wall to be faced, the first strip having a first edge and a second edge;

a riser strip extending from the second edge of the first strip, the riser strip having a lower edge coincident with the second edge and an upper edge spaced therefrom;

a second strip including an edge which is parallel to and spaced-apart from the first strip by a predetermined distance, the edge extending from the upper edge of the riser strip and providing a screed against which a tool may be drawn to smooth a cement layer on the first wall having a thickness corresponding to the predetermined distance; and a nailer strip extending from the second strip for joining the article to the second wall, the nailer strip being spaced from the riser strip and generally perpendicular to the first strip, the nailer strip including a raised bead against which a trowel may be used to apply joint compound over the nailer strip.

15. The article of claim 14, wherein the second strip is spaced apart from the first strip by a distance of ½-inch.

16. The article of claim 14, wherein the second strip is generally parallel to the first strip.

17. The article of claim 14, wherein the riser strip is generally perpendicular to the first strip.

* * * * *